US009897089B2

(12) United States Patent
Watanabe et al.

(10) Patent No.: US 9,897,089 B2
(45) Date of Patent: Feb. 20, 2018

(54) SCROLL COMPRESSOR

(71) Applicants: AISIN SEIKI KABUSHIKI KAISHA, Kariya-shi (JP); SANDEN HOLDINGS CORPORATION, Isesaki-shi (JP)

(72) Inventors: Yoshimi Watanabe, Kariya (JP); Shigeyuki Sunahara, Kariya (JP); Hiroshi Fujita, Isesaki (JP); Ryosuke Miyazawa, Isesaki (JP); Naoya Kogure, Isesaki (JP); Tatsuki Nomura, Isesaki (JP)

(73) Assignees: AISIN SEIKI KABUSHIKI KAISHA, Kariya-shi (JP); SANDEN HOLDINGS CORPORATION, Isesaki-shi (JP)

( * ) Notice: Subject to any disclaimer, the term of this patent is extended or adjusted under 35 U.S.C. 154(b) by 196 days.

(21) Appl. No.: 15/016,844

(22) Filed: Feb. 5, 2016

(65) Prior Publication Data

US 2016/0230765 A1 Aug. 11, 2016

(30) Foreign Application Priority Data

Feb. 5, 2015 (JP) ..... 2015-021573

(51) Int. Cl.
*F04C 29/12* (2006.01)
*F04C 18/02* (2006.01)
*F04C 29/00* (2006.01)

(52) U.S. Cl.
CPC ..... *F04C 29/128* (2013.01); *F04C 18/0215* (2013.01); *F04C 29/0007* (2013.01)

(58) Field of Classification Search
CPC ..... F04C 18/0215; F04C 23/008; F25B 1/04; F25B 41/04; F01C 11/004
USPC ..... 418/55.1–55.6
See application file for complete search history.

(56) References Cited

U.S. PATENT DOCUMENTS 5,249,939 A * 10/1993 Takahashi ..... F04B 27/1009 417/566
7,513,753 B2 * 4/2009 Shin ..... F04C 28/16 417/310
2005/0019177 A1 * 1/2005 Shin ..... F04C 18/0215 417/410.5

(Continued)

FOREIGN PATENT DOCUMENTS

JP 2009-287512 12/2009

*Primary Examiner* — Mark Laurenzi
*Assistant Examiner* — Dapinder Singh
(74) *Attorney, Agent, or Firm* — Oblon, McClelland, Maier & Neustadt, L.L.P.

(57) ABSTRACT

A scroll compressor includes a pair of spiral plate bodies between which a compression chamber that compresses refrigerant is formed; a support configured to support one of the spiral plate bodies; a plurality of refrigerant paths extending through the support so as to provide communication between the compression chamber and an outside of the scroll compressor; and a plurality of check valves each of which is provided in the support for a corresponding one of the refrigerant paths, wherein each of the plurality of check valves includes a valve element and a valve chamber in which the valve element is accommodated, and at least one of the check valves is placed at a position away from a rest of the check valves in a rotation axis direction of the scroll compressor such that the valve chambers of the check valves do not interfere with each other.

7 Claims, 2 Drawing Sheets

(56) References Cited

U.S. PATENT DOCUMENTS

2005/0019178 A1* 1/2005 Shin ..... F04C 28/16
417/410.5

* cited by examiner

SCROLL COMPRESSOR

INCORPORATION BY REFERENCE

The disclosure of Japanese Patent Application No. 2015-021573 filed on Feb. 5, 2015 including the specification, drawings and abstract is incorporated herein by reference in its entirety.

BACKGROUND OF THE INVENTION

1. Field of the Invention

The present invention relates to a scroll compressor configured to compress refrigerant in a compression chamber formed between a pair of spiral plate bodies.

2. Description of Related Art

A scroll compressor is widely used as a refrigerant compressor configured to compress refrigerant of an air-conditioning device (an air conditioner or the like), for example. Generally, the scroll compressor includes a fixed scroll fixed to a housing (a case) and a movable scroll that performs an eccentrically circular movement relative to the fixed scroll. The fixed scroll and the movable scroll each include a spiral plate body and a discoid support that supports the spiral plate body, and refrigerant is compressed in a compression chamber formed therebetween. The refrigerant thus compressed is discharged to the outside of the scroll compressor via a refrigerant path (a discharge port) that provides communication between the compression chamber and the outside of the scroll compressor.

Generally, the scroll compressor includes various refrigerant paths suitable for various purposes in addition to the above refrigerant path (the discharge port). For example, in order to improve efficiency (Coefficient of Performance (COP)) of the air-conditioning device, one conventional scroll compressor (hereinafter referred to as the "conventional compressor") includes a refrigerant path (a so-called injection port) configured to inject, from the outside, refrigerant into refrigerant that is in a process of compression. The conventional compressor includes a check valve including a reed valve extending in a direction parallel to a rotating shaft of the compressor, as a check valve provided on the refrigerant path. Since this check valve has a small sectional area on a cut surface orthogonal to the rotating shaft as compared with a check valve including a reed valve extending in a direction "perpendicular" to the rotating shaft, it is possible to relatively easily avoid mutual interference between check valves (e.g., see Japanese Patent Application Publication No. 2009-287512 (JP 2009-287512 A)).

Hereinafter, for the sake of convenience, the check valve including the reed valve extending in the direction parallel to the rotating shaft of the compressor is referred to as a "parallel check valve," and the check valve including the reed valve extending in the direction "perpendicular" to the rotating shaft of the compressor is referred to as a "perpendicular check valve."

In recent years, from the viewpoint of further improving efficiency of an air-conditioning device, the number of refrigerant paths that provides communication between a compression chamber of a scroll compressor and the outside tends to increase. For example, as the aforementioned refrigerant path (the injection port) configured to inject, from the outside, refrigerant into refrigerant in a process of compression, a plurality of injection ports for a cooling operation and a plurality of injection ports for a heating operation may be provided. Further, there may be provided a refrigerant path (a so-called relief port) configured to discharge part of the refrigerant from the compression chamber in order to avoid excessive compression of the refrigerant; and a refrigerant path (a so-called reducing port) configured to discharge part of the refrigerant that is in a process of compression at the time when the air-conditioning device is operated with a low load.

Generally, the plurality of refrigerant paths is provided so as to extend through a support (both the discoid support and the housing described above) that supports the fixed scroll of the scroll compressor. Respective check valves are provided in the support so as to correspond to those refrigerant paths. Therefore, as the number of refrigerant paths increases, the number of check valves that should be provided in the support also increases. As a result, it is difficult to dispose the refrigerant paths and the check valves in the support while avoiding mutual interference between the check valves.

As described above, the conventional compressor includes a parallel check valve so as to avoid the mutual interference between the check valves. However, in a case where the parallel check valve is used, it is necessary to form a refrigerant path so that a reed valve curves (in an opening/closing manner) in a direction perpendicular to the rotating shaft of the compressor because of the structure of the parallel check valve. Therefore, in a case where the parallel check valves are used, it is possible to relatively easily avoid mutual interference between check valves, but shapes of the refrigerant paths may become complicated in comparison with a case where the perpendicular check valves are used. Further, due to the complicated shape of each refrigerant path, a pressure loss in the refrigerant path increases, which may decrease efficiency of the air-conditioning device.

SUMMARY OF THE INVENTION

The present invention provides a scroll compressor that can prevent a plurality of refrigerant paths from becoming complicated as much a possible while avoiding mutual interference between check valves, even in a case where the scroll compressor includes the plurality of refrigerant paths each of which provides communication between a compression chamber of the scroll compressor and an outside of the scroll compressor.

An aspect of the present invention relates to a scroll compressor including a pair of spiral plate bodies between which a compression chamber that compresses refrigerant is formed; a support configured to support one of the spiral plate bodies; a plurality of refrigerant paths extending through the support so as to provide communication between the compression chamber and an outside of the scroll compressor; and a plurality of check valves each of which is provided in the support for a corresponding one of the refrigerant paths, wherein each of the plurality of check valves includes a valve element and a valve chamber in which the valve element is accommodated, and at least one of the check valves is placed at a position away from a rest of the check valves in a rotation axis direction of the scroll compressor such that the valve chambers of the check valves do not interfere with each other.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a schematic configuration of a scroll compressor 1 (hereinafter referred to as the "compressor 1") according to an embodiment of the present invention will be described with reference to the drawings.

Figure 1:
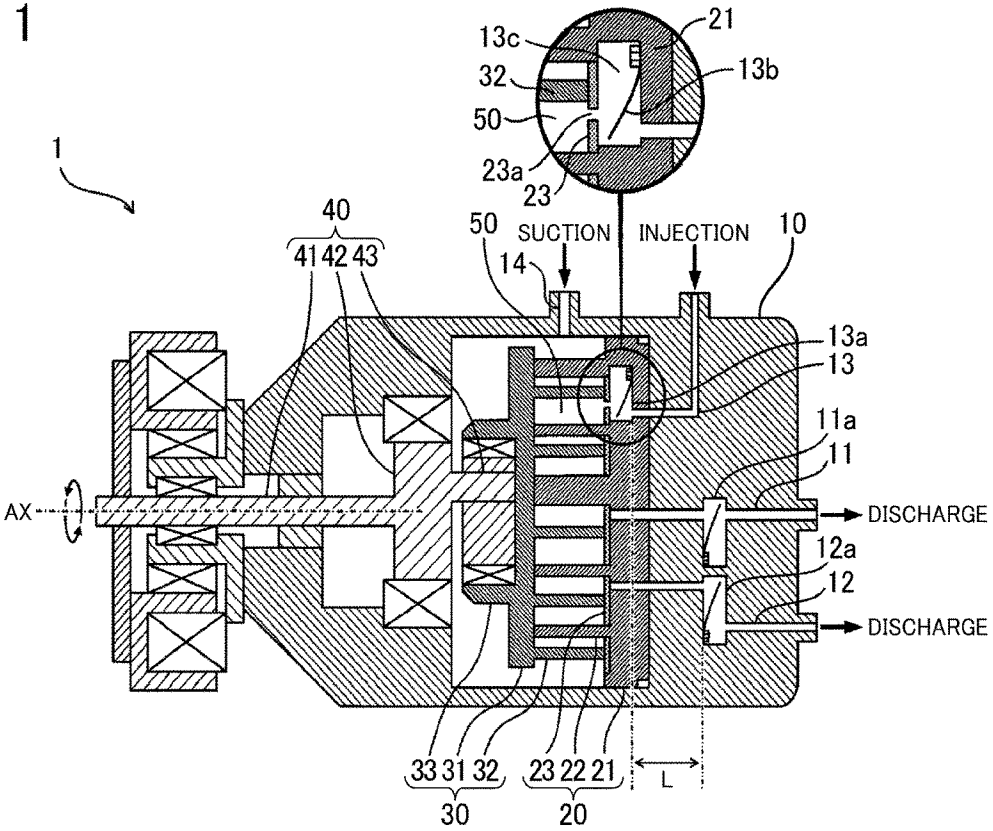
FIG. 1 is a schematic view illustrating a section of a scroll compressor according to an embodiment of the present invention.

FIG. 1 is a schematic view illustrating a section of the compressor 1. The compressor 1 includes a case (housing) 10, a fixed scroll 20 supported by the housing 10, a movable scroll 30 meshed with the fixed scroll 20, and a shaft 40 that causes the movable scroll 30 to perform an eccentrically circular movement (a turning movement).

The fixed scroll 20 includes a discoid support 21, a spiral plate body 22 supported by the discoid support 21, and an abrasion prevention plate 23 that prevents abrasion of the movable scroll 30. The discoid support 21 is fixed to the housing 10 with screws or the like (not shown). That is, the spiral plate body 22 is supported immovably relative to the housing 10 by both the discoid support 21 and the housing 10 that fixes the discoid support 21. In view of this, the discoid support 21 and the housing 10 are collectively referred to as a "support for the spiral plate body 22."

The movable scroll 30 includes a discoid support 31, a spiral plate body 32 supported by the discoid support 31, and a flange portion 33. The spiral plate body 32 is provided to extend from the discoid support 31 toward the fixed scroll 20. The flange portion 33 has a tonic shape, and is provided to extend in a direction away from the fixed scroll 20.

The spiral plate body 22 of the fixed scroll 20 and the spiral plate body 32 of the movable scroll 30 are placed to mesh with each other. Thus, a compression chamber 50 that compresses refrigerant is formed between the spiral plate body 22 of the fixed scroll 20 and the spiral plate body 32 of the movable scroll 30.

The shaft 40 includes a rotating shaft 41, a large diameter portion 42 connected to the rotating shaft 41, and an eccentric pin 43 provided in the large diameter portion 42. The eccentric pin 43 is provided at a position eccentric relative to a shaft center (an axis AX of the rotating shaft 41) of the shaft 40. The eccentric pin 43 is connected to the flange portion 33 of the movable scroll 30 via a bush, a bearing, and the like. When the rotating shaft 41 is rotated by a power supplied from a power source (e.g., a motor, a gas engine, or the like) outside the compressor 1, the movable scroll 30 is rotated via the large diameter portion 42 and the eccentric pin 43. At this time, spinning of the movable scroll 30 is restrained due to an Oldham's coupling (not shown), so the movable scroll 30 performs an eccentrically circular movement (a turning movement). Due to the eccentrically circular movement, the compression chamber 50 formed between the pair of spiral plate bodies 22, 32 moves from an outer peripheral side of the fixed scroll 20 toward a central part of the fixed scroll 20 while a volume of the compression chamber 50 is reduced gradually. Thus, the refrigerant in the compression chamber 50 is compressed.

In the meantime, the support (21, 10) for the spiral plate body 22 of the fixed scroll 20 is provided with a plurality of refrigerant paths for providing communication between the compression chamber 50 and an outside of the compressor 1. More specifically, there are provided a refrigerant path (a discharge port) 11 configured to discharge refrigerant that has been compressed, from the compression chamber 50 toward the outside; a refrigerant path (a reducing port) 12 configured to discharge part of refrigerant that is in a process of compression, for example, at the time when an air-conditioning device is operated with a low load, in a case where the compressor 1 is applied to the air-conditioning device; and a refrigerant path (an injection port) 13 configured to inject refrigerant into the refrigerant in the process of compression from the outside, in order to improve efficiency of the air-conditioning device. These refrigerant paths are formed so as to extend through the support (21, 10). In the present embodiment, since the abrasion prevention plate 23 is provided so as to be adjacent to the compression chamber 50, the refrigerant paths are formed so as to extend through the abrasion prevention plate 23. Note that the housing 10 is also provided with a refrigerant path (a supply port) 14 configured to supply refrigerant that has not been compressed, to the compression chamber 50. However, the refrigerant path (the supply port) 14 is formed so as not to extend through the support (21, 10) for the spiral plate body 22.

Check valves 11*a*, 12*a*, 13*a* are respectively provided in the plurality of refrigerant paths 11, 12, 13. More specifically, in order to avoid mutual interference between the check valves, at least one (13*a*) of the check valves 11*a*, 12*a*, 13*a* is placed at a position away from the rest (11*a*, 12*a*) of the check valves 11*a*, 12*a*, 13*a* by a distance L in a rotation axis direction (a direction parallel to the axis AX of the rotating shaft 41) of the compressor 1.

In other words, the check valve 13*a* provided in the refrigerant path (the injection port) 13 configured to inject the refrigerant into the compression chamber 50 is placed at a position closer to the compression chamber 50 than the check valves 11*a*, 12*a* are, the check valves 11*a*, 12*a* being provided in the refrigerant paths (the discharge port and the reducing port) 11, 12 configured to discharge the refrigerant from the compression chamber 50.

The structure and the arrangement of the check valves will be more specifically described below with the check valve 13*a* being taken as an example. As illustrated in a partial enlarged view in the figure, the check valve 13*a* includes a reed valve 13*b* as a valve element. Further, the check valve 13*a* includes, as a valve chamber, a hollow portion defined by a recessed portion 13*c* formed on a side face of the support (the discoid support 21) for the spiral plate body 22 and the abrasion prevention plate 23 that closes the recessed portion 13*c*, the side face of the support being opposed to the compression chamber 50. The abrasion prevention plate 23 is provided with a through-hole 23*a* that provides communication between the valve chamber (the hollow portion) of the check valve 13*a* and the compression chamber 50, and the refrigerant is injected into the compression chamber via the through-hole 23*a*. Note that each of the other check valves 11*a*, 12*a* also includes a reed valve as a valve element and a hollow portion as a valve chamber, as well as the check valve 13*a*. Note that the figure illustrates a state where the reed valve 13*b* of the check valve 13*a* is opened for the sake of convenience. However, the reed valve 13*b* is opened and closed according to an operational state of the compressor 1 (more specifically, based on a magnitude relationship between a refrigerant pressure upstream of the reed valve 13*b* and a refrigerant pressure downstream of the reed valve 13*b*). The same can be said about the other check valves 11*a*, 12*a*. The reed valve 13*b* extends in a direction perpendicular to the rotation axis direction. A reed valve of each of the other check valves 11*a*, 12*a* also extends in the direction perpendicular to the rotation axis direction.

In the compressor 1 configured as described above, at least one (13*a*) of the check valves is placed at a position away from the rest (11*a*, 12*a*) of the check valves (that is, at least one (13*a*) of the check valves and the rest (11*a*, 12*a*) of the check valves are placed in a multi-layered manner) in the rotation axis direction. Accordingly, in comparison with a case where all the check valves (11*a*, 12*a*, 13*a*) are placed at the same position (that is, in a single-layered manner) in the rotation axis direction, a check-valve density per layer is reduced. This makes it to more easily avoid mutual interference between the check valves and to prevent the refrigerant paths 11, 12, 13 from being complicated.

Further, a position of the check valve 13*a* (the injection port), which is important from the viewpoint of reducing a recompression loss, is placed at a position closer to the compression chamber 50 than the check valves 11*a*, 12*a* (the discharge port, the reducing port) in which a recompression loss is relatively unlikely to occur. More specifically, the check valve 13*a* is placed at a position adjacent to the compression chamber 50. This accordingly makes it possible to reduce a distance (in other words, a recompression volume) from the check valve 13*a* to the compression chamber 50, thereby making it possible to reduce an overall recompression loss in the plurality of refrigerant paths. As a result, in a case where the compressor 1 is applied to the air-conditioning device, it is possible to improve efficiency (COP) of the air-conditioning device.

The present invention is not limited to the above embodiment, and various modifications can be made within a scope of the present invention.

For example, the compressor 1 includes three refrigerant paths 11, 12, 13 in FIG. 1. However, the scroll compressor of the present invention may be configured to include four or more refrigerant paths. For example, the scroll compressor of the present invention may include a plurality of injection ports for a cooling operation and a plurality of injection ports for a heating operation as the injection port (the refrigerant path 13) described above. Further, the scroll compressor of the present invention may include a refrigerant path (a so-called relief port) configured to discharge part of the refrigerant from the compression chamber in order to avoid excessive compression of the refrigerant. Even in a case where the number of refrigerant paths increases (that is, even if the number of check valves provided in the support increases), it is possible to relatively easily avoid mutual interference between the check valves by placing the check valves in a multi-layered manner.

Figure 2:
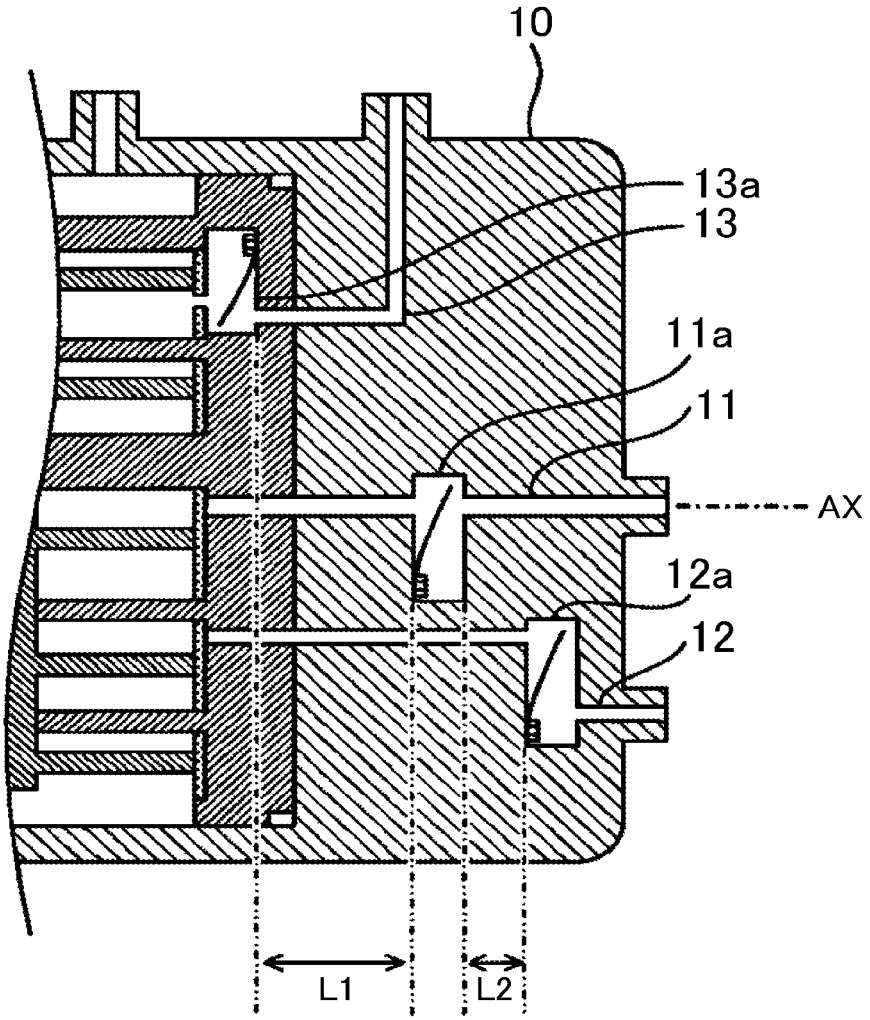
FIG. 2 is a schematic view illustrating a scroll compressor according to another embodiment of the present invention.

Further, the compressor 1 is configured such that the check valves 11*a*, 12*a* are placed at the same position in the rotation axis direction (in the axis direction AX), and the check valve 13*a* is placed at a position away from the check valves 11*a*, 12*a* in the rotation axis direction. However, in the scroll compressor of the present invention, the check valves may be placed such that the check valve 13*a* and the check valve 12*a* are away from each other by a distance L1 in the rotation axis direction and the check valve 12*a* and the check valve 11*a* are away from each other by a distance L2 in the rotation axis direction, as illustrated in FIG. 2. That is, the check valves may be placed so that all of the check valves are located at different positions in the rotation axis direction AX.

An aspect of the present invention relates to a scroll compressor including a pair of spiral plate bodies between which a compression chamber that compresses refrigerant is formed; a support configured to support one of the spiral plate bodies; a plurality of refrigerant paths extending through the support so as to provide communication between the compression chamber and an outside of the scroll compressor; and a plurality of check valves each of which is provided in the support for a corresponding one of the refrigerant paths, wherein each of the plurality of check valves includes a valve element and a valve chamber in which the valve element is accommodated, and at least one of the check valves is placed at a position away from a rest of the check valves in a rotation axis direction of the scroll compressor such that the valve chambers of the check valves do not interfere with each other.

With the above configuration, in a case where the scroll compressor includes the "plurality of refrigerant paths extending through the support configured to support one of the spiral plate bodies" and the "plurality of check valves each of which is provided in the support for a corresponding one of the refrigerant paths", in order that the plurality of check valves should be provided at positions such that "the valve chambers of the check valves do not interfere with each other" (that is, mutual interference between the check valves is avoided), "at least one of the check valves" is placed at a position away from "the rest of the check valves in the rotation axis direction of the scroll compressor." In other words, the "plurality of check valves" is placed in a multi-layered manner in the "rotation axis direction of the scroll compressor."

When "at least one of the check valves" is placed at a position away from "the rest of the check valves" (that is, the "plurality of check valves" is placed in a multi-layered manner) in the rotation axis direction, a check-valve density per layer is reduced in comparison with a case where all the check valves are placed at the same position (that is, in a single-layered manner) in the rotation axis direction. Accordingly, it is possible to more easily avoid mutual interference between the check valves. Thus, with the above configuration, it is possible to avoid the mutual interference between the check valves without using parallel check valves used in a conventional compressor (that is, without complicating the refrigerant paths).

Thus, in the scroll compressor of the present invention, it is possible to avoid the mutual interference between the check valves, and to prevent the refrigerant paths from becoming complicated. Thus, in the scroll compressor of the present invention, even in a case where the scroll compressor includes the plurality of refrigerant paths that provides communication between the compression chamber of the scroll compressor and the outside of the scroll compressor, it is possible to prevent the refrigerant paths from becoming complicated as much as possible while avoiding the mutual interference between the check valves.

In the meantime, the "pair of spiral plate bodies" can be also expressed as a spiral plate body included in a fixed scroll fixed to a case (a housing) of the scroll compressor and a spiral plate body included in a movable scroll that performs an eccentrically circular movement relative to the fixed scroll. Further, the "support configured to support one of the spiral plate bodies" can be also expressed as a support including a "discoid support that supports the spiral plate body included in the fixed scroll" and "the housing (case) that fixes the discoid support."

The "plurality of refrigerant paths extending through the support so as to provide communication between the compression chamber and an outside of the scroll compressor" does not necessarily need to continue to provide communication between them during the entire process of compression (that is, regardless of a position of the compression chamber that performs a turning movement along with the compression of the refrigerant), and may provide communication between them in at least a part of the process of compression (only at the time when the compression chamber is placed at a specific position). In other words, the "plurality of refrigerant paths" can be configured to be opened toward the compression chamber only at the time when the compression chamber is placed at a given position among positions from a compression staring position to a compression completion position.

The "check valve" may include a mechanism that prevents reverse flow of the refrigerant flowing through the refrigerant path, and a specific structure or the like thereof is not limited in particular. For example, as the "valve element" of the check valve, a reed valve having a thin-sheet shape and configured such that one end thereof is a fixed end and the other end thereof is a free end, a sphere urged by an elastic force of a spring or the like so as to close the refrigerant path, and the like can be used. Further, a hollow portion or the like that secures a movable range of the valve element can be used as the "valve chamber" of the check valve, for example. Note that the check valve may be configured such that one valve element is accommodated in one valve chamber, or may be configured such that a plurality of valve elements is accommodated in one valve chamber.

That the phrase "the valve chambers do not interfere with each other" indicates such a state where one valve chamber and another valve chamber are separated from each other so that they do not overlap (make contact) with each other and the refrigerant cannot flow therebetween.

The "rotation-axis direction of the scroll compressor" indicates a direction parallel to an axis of a rotating shaft for causing the spiral plate body (the spiral plate body of the movable scroll) that is not supported by the "support" to perform an eccentrically circular movement.

The phrase "at least one of the check valves is placed at a position away from a rest of the check valves in a rotation axis direction" can be also expressed as "at least one of the check valves is placed at a position offset from a rest of the check valves in a rotation-axis direction." Further, this phrase can be also expressed as "at least one of the check valves and a rest of the check valves are placed such that a distance obtained by reflecting, in a rotational axis direction, a minimum distance between the at least one of the check valves and the rest of the check valves is larger than zero." In addition, this phrase can be expressed as "at least one of the check valves and a rest of the check valves are placed such that a partition wall perpendicular to a rotation axis direction is sandwiched therebetween (note that a thickness of the partition wall in the rotation axis direction is larger than zero)."

The aforementioned arrangement of the check valves should be determined in consideration of various requirements regarding the scroll compressor (e.g., a magnitude of a pressure loss in a refrigerant path, efficiency of an air-conditioning device in a case where the scroll compressor is applied to the air-conditioning device, and the like).

For example, the arrangement of the check valves can be determined so as to minimize a recompression loss in a refrigerant path (details thereof will be described later). More specifically, refrigerant existing in a path between the compression chamber and a check valve (hereinafter referred to as an "injection check valve") provided in a refrigerant path configured to "inject" the refrigerant to the compression chamber (more strictly, in a path downstream of a valve element of the injection check valve and upstream of an opening of the refrigerant path to the compression chamber) cannot flow in a direction from the compression chamber to the outside (a reverse flow direction). Accordingly, when the injection check valve is closed, a refrigerant pressure in this path fluctuates according to a refrigerant pressure in the compression chamber that communicates with the path (the compression chamber on which the path is opened).

More specifically, in general, the movable scroll performs an eccentrically circular movement in a state where the movable scroll is sandwiched between a high-pressure compression chamber and a low-pressure compression chamber. Accordingly, the refrigerant pressure in this path repeatedly increases and decreases every time the movable scroll passes over the opening of the path. In other words, the refrigerant existing in this path is repeatedly pressurized and depressurized (compression, expansion, recompression, re-expansion are repeated) along with the eccentrically circular movement of the movable scroll. The energy used for the pressurization (compression) generally becomes a heat loss or the like, and does not contribute to any work of the scroll compressor at all.

In view of this, a volume of this path is generally called a "recompression volume," and an energy loss caused due to an increased/decreased pressure of the refrigerant in the path is called a "recompression loss." It is desirable that the recompression volume and the recompression loss be as small as possible from the viewpoint of improving performance of the scroll compressor (for example, efficiency of the air-conditioning device to which the scroll compressor is applied).

Note that, refrigerant existing in a path between the compression chamber and a check valve (hereinafter referred to as a "discharge check valve") provided in a refrigerant path configured to "discharge" the refrigerant from the compression chamber can flow in a direction from the compression chamber to the outside (a forward direction of the check valve), unlike the injection check valve. Therefore, in the discharge check valve, a recompression loss is relatively unlikely to occur.

In view of this, as one example of the arrangement of a plurality of check valves, the plurality of check valves may be placed such that an injection check valve provided in a refrigerant path that is included in the refrigerant paths and configured to inject refrigerant into the compression chamber is located at a position closer to the compression chamber than a discharge check valve is, the discharge check valve being provided in a refrigerant path that is included in the refrigerant paths and configured to discharge the refrigerant from the compression chamber.

In the above configuration, a position of the "injection check valve", which is important from the viewpoint of reducing a recompression loss, is set so as to be "located at a position closer to the compression chamber" than the "discharge check valve" in which a recompression loss is relatively unlikely to occur. In comparison with a case where the above arrangement is not employed, a distance (in other words, a recompression volume) from the injection check valve to the compression chamber is decreased, thereby making it possible to reduce an overall recompression loss in the plurality of refrigerant paths. As a result, the performance of the scroll compressor (efficiency of the air-conditioning device to which the scroll compressor is applied) is improved.

Note that the arrangement of the check valves may be determined in consideration of other requirements (e.g., easiness with which machining is performed to form a refrigerant path and a check valve (particularly, a valve chamber) in a support, a size of the compressor itself, and the like), in addition to the reduction of the recompression loss or separately from the reduction of the recompression loss.

Further, as is understood from the above description, the recompression loss is smaller as the recompression volume is smaller. In view of this, from the viewpoint of reducing the recompression loss, it is desirable that the injection check valve be provided at a position as close as possible to the compression chamber. Further, when the injection check valve is placed as described above, pressure drop of refrigerant (refrigerant with an intermediate pressure, which is injected from a so-called injection port) to be injected into the refrigerant in the process of compression can be prevented as much as possible.

In view of this, as one example of the arrangement of the injection check valve, in a case where the injection check valve is provided in the refrigerant path configured to inject the refrigerant into the refrigerant in the process of compression from the outside, the check valve may be placed at the position that is adjacent to the compression chamber.

In the above configuration, since the injection check valve is provide at the "position that is adjacent to the compression chamber," it is possible to reduce a recompression loss in the refrigerant path (a so-called injection port) configured to "inject the refrigerant into the refrigerant in the process of compression from the outside" as much as possible, and to maintain a pressure of the refrigerant until immediately before the injection of the refrigerant. As a result, the performance of the scroll compressor (efficiency of the air-conditioning device to which the scroll compressor is applied) is further improved.

However, in general, in the principle of the scroll compressor, it is difficult to make the distance between the check valve and the compression chamber zero, for the following reason. In a case where the distance is zero, the valve chamber of the check valve may communicate with a plurality of compression chambers (e.g., a high-pressure compression chamber and a low-pressure compression chamber between which the movable scroll is sandwiched) at the same time, so that the compression of the refrigerant itself may be disturbed. Accordingly, the phrase "placed at the position that is adjacent to the compression chamber" does not necessarily indicate that the distance between the compression chamber and the injection check valve is zero, and indicates that the injection check valve and the compression chamber are placed at positions that are close to each other to such an extent that they can be regarded as being "adjacent" to each other from the viewpoint of reducing a recompression loss.

A specific technique to place the injection check valve at the "position that is adjacent to the compression chamber" is not limited in particular.

For example, as one example of the technique to place the injection check valve, the injection check valve may include a reed valve as the valve element; and the injection check valve may include, as the valve chamber, a hollow portion defined by a recessed portion formed on a side face of the support and a cover portion that closes the recessed portion, the side face of the support being opposed to the compression chamber.

In the above configuration, a distance between the compression chamber and the valve chamber (a hollow portion defined by the recessed portion and the cover portion) of the injection check valve substantially corresponds to a thickness of the "cover portion." Therefore, when the thickness of the "cover portion" is reduced sufficiently, the injection check valve and the compression chamber can be placed at positions that are close to each other to such an extent that they can be regarded as being "adjacent" to each other from the viewpoint of reducing a recompression loss.

Note that, in this example, the refrigerant can be injected into the compression chamber by providing a through-hole at a desired position in the "cover portion." Further, for example, when an abrasion prevention plate (that is generally provided on a surface of the fixed scroll) that prevents abrasion of a distal end of a plate body of the movable scroll is used as the "cover portion," it is possible to place the injection check valve as described above without increasing the number of components of the scroll compressor.

What is claimed is:

1. A scroll compressor comprising:

a pair of spiral plate bodies between which a compression chamber that compresses refrigerant is formed;

a support configured to support one of the spiral plate bodies;

a plurality of refrigerant paths extending through the support so as to provide communication between the compression chamber and an outside of the scroll compressor; and a plurality of check valves each of which is provided in the support for a corresponding one of the refrigerant paths, wherein each of the plurality of check valves includes a valve element and a valve chamber in which the valve element is accommodated, and at least one of the check valves is placed at a position away from a rest of the check valves in a rotation axis direction of the scroll compressor such that the valve chambers of the check valves do not interfere with each other.

2. The scroll compressor according to claim 1, wherein one of the check valves is placed at the position away from the rest of the check valves in the rotation axis direction of the scroll compressor.

3. The scroll compressor according to claim 1, wherein the plurality of check valves is placed such that an injection check valve provided in a refrigerant path that is included in the refrigerant paths and configured to inject the refrigerant into the compression chamber is located at a position closer to the compression chamber than a discharge check valve is, the discharge check valve being provided in a refrigerant path that is included in the refrigerant paths and configured to discharge the refrigerant from the compression chamber.

4. The scroll compressor according to claim 3, wherein the injection check valve is provided in the refrigerant path configured to inject, from the outside of the scroll compressor, the refrigerant into the refrigerant that is in a process of compression, and the injection check valve is placed at the position that is adjacent to the compression chamber.

5. The scroll compressor according to claim 4, wherein:

the injection check valve includes a reed valve as the valve element; and the injection check valve includes, as the valve chamber, a hollow portion defined by a recessed portion formed on a side face of the support and a cover portion that closes the recessed portion, the side face of the support being opposed to the compression chamber.

6. The scroll compressor according to claim 5, wherein the cover portion is provided with a through-hole that provides communication between the hollow portion of the injection check valve and the compression chamber.

7. The scroll compressor according to claim 1, wherein each of the plurality of check valves includes a reed valve that extends in a direction perpendicular to the rotation axis direction of the scroll compressor.

* * * * *